US010215020B2

(12) United States Patent
Derkacz et al.

(10) Patent No.: US 10,215,020 B2
(45) Date of Patent: Feb. 26, 2019

(54) MUD MOTOR WITH INTEGRATED MWD SYSTEM

(71) Applicant: EVOLUTION ENGINEERING INC., Calgary (CA)

(72) Inventors: Patrick R. Derkacz, Calgary (CA); Aaron William Logan, Calgary (CA); Justin C. Logan, Calgary (CA)

(73) Assignee: Evolution Engineering Inc., Calgary (CA)

( * ) Notice: Subject to any disclaimer, the term of this patent is extended or adjusted under 35 U.S.C. 154(b) by 81 days.

(21) Appl. No.: 15/320,007

(22) PCT Filed: May 8, 2015

(86) PCT No.: PCT/CA2015/050417

§ 371 (c)(1),
(2) Date: Dec. 19, 2016

(87) PCT Pub. No.: WO2015/192224

PCT Pub. Date: Dec. 23, 2015

(65) Prior Publication Data

US 2017/0122040 A1 May 4, 2017

Related U.S. Application Data

(60) Provisional application No. 62/013,921, filed on Jun. 18, 2014.

(51) Int. Cl.
*E21B 47/12* (2012.01)
*E21B 4/02* (2006.01)

(52) U.S. Cl.
CPC ..... *E21B 47/122* (2013.01); *E21B 4/02* (2013.01)

(58) Field of Classification Search
CPC ..... E21B 4/02; E21B 47/122
See application file for complete search history.

(56) References Cited

U.S. PATENT DOCUMENTS 5,174,765 A * 12/1992 Williams ..... E21B 17/028 439/426
5,725,061 A 3/1998 Van Steenwyk et al.
6,392,561 B1 5/2002 Davies et al.
7,477,162 B2 1/2009 Clark
(Continued)

FOREIGN PATENT DOCUMENTS

CA 2472674 A1 1/2005
WO 0165056 A1 9/2001
(Continued)

*Primary Examiner* — D. Andrews
(74) *Attorney, Agent, or Firm* — Oyen Wiggs Green & Mutala LLP

(57) ABSTRACT

A measurement-while-drilling system is integrated into a mud motor. The measurement-while-drilling system includes sensors which may include inclination and tool face sensors, for example, located near to the drill bit. Data from the near bit sensors is transmitted by way of telemetry, for example, EM telemetry. The mud motor may include a rotating electrical coupling which provides good electrical productivity between an uphole coupling of the mud motor and the rotating mandrel. The EM telemetry transmitter may include an electrically-insulating gap integrated with the mandrel of the mud motor.

13 Claims, 6 Drawing Sheets

(56) References Cited

U.S. PATENT DOCUMENTS

| | | | | |
|---|---|---|---|---|
| 8,011,425 | B2 | 9/2011 | Konschuh et al. | |
| 2006/0254819 | A1 | 11/2006 | Moriarty | |
| 2011/0278066 | A1 | 11/2011 | Konschuh et al. | |
| 2012/0085583 | A1 | 4/2012 | Logan et al. | |
| 2013/0213129 | A1* | 8/2013 | Kumar ..... | E21B 47/0006 73/152.47 |

FOREIGN PATENT DOCUMENTS

| | | | |
|---|---|---|---|
| WO | 2006083764 | A1 | 8/2006 |
| WO | 2013191688 | A1 | 12/2013 |
| WO | 2015031973 | A1 | 3/2015 |

* cited by examiner

MUD MOTOR WITH INTEGRATED MWD SYSTEM

TECHNICAL FIELD

This application relates to subsurface drilling, specifically, to drilling which uses a mud motor to drive a drill bit. Embodiments are applicable to drilling wells for recovering hydrocarbons.

BACKGROUND

Recovering hydrocarbons from subterranean zones typically involves drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid, usually in the form of a drilling "mud", is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at surface.

Bottom hole assembly (BHA) is the name given to the equipment at the terminal end of a drill string. In addition to a drill bit, a BHA may comprise elements such as: apparatus for steering the direction of the drilling (e.g. a steerable downhole mud motor or rotary steerable system); sensors for measuring properties of the surrounding geological formations (e.g. sensors for use in well logging); sensors for measuring downhole conditions as drilling progresses; one or more systems for telemetry of data to the surface; stabilizers; heavy weight drill collars; pulsers; and the like. The BHA is typically advanced into the wellbore by a string of metallic tubulars (drill pipe).

Modern drilling systems may include any of a wide range of mechanical/electronic systems in the BHA or at other downhole locations. Such electronics systems may be packaged in various ways in the drill string. A downhole system may provide any of a wide range of functions including, without limitation: data acquisition; measuring properties of the surrounding geological formations (e.g. well logging); measuring downhole conditions as drilling progresses; controlling downhole equipment; monitoring status of downhole equipment; directional drilling applications; measuring while drilling (MWD) applications; logging while drilling (LWD) applications; measuring properties of downhole fluids; and the like. A probe may comprise one or more systems for: telemetry of data to the surface; collecting data by way of sensors (e.g. sensors for use in well logging) that may include one or more of vibration sensors, magnetometers, inclinometers, accelerometers, nuclear particle detectors, electromagnetic detectors, acoustic detectors, and others; acquiring images; measuring fluid flow; determining directions; emitting signals, particles or fields for detection by other devices; interfacing to other downhole equipment; sampling downhole fluids; etc. A downhole probe is typically suspended in a bore of a drill string near the drill bit. Some downhole probes are highly specialized and expensive.

Downhole conditions can be harsh. A downhole system may experience high temperatures; vibrations (including axial, lateral, and torsional vibrations); shocks; immersion in drilling fluids; high pressures (20,000 p.s.i. or more in some cases); turbulence and pulsations in the flow of drilling fluid near the downhole system; fluid initiated harmonics; and torsional acceleration events from slip which can lead to side-to-side and/or torsional movement of the downhole system. These conditions can shorten the lifespan of downhole systems and can increase the probability that a downhole system will fail in use. Replacing a downhole system that fails while drilling can involve very great expense.

A downhole system may communicate a wide range of information to the surface by telemetry. Telemetry information can be invaluable for efficient drilling operations. For example, telemetry information may be used by a drill rig crew to make decisions about controlling and steering the drill bit to optimize the drilling speed and trajectory based on numerous factors, including legal boundaries, locations of existing wells, formation properties, hydrocarbon size and location, etc. A crew may make intentional deviations from the planned path as necessary based on information gathered from downhole sensors and transmitted to the surface by telemetry during the drilling process. The ability to obtain and transmit reliable data from downhole locations allows for relatively more economical and more efficient drilling operations.

There are several known telemetry techniques. These include transmitting information by generating vibrations in fluid in the bore hole (e.g. acoustic telemetry or mud pulse (MP) telemetry) and transmitting information by way of electromagnetic signals that propagate at least in part through the earth (EM telemetry). Other telemetry techniques use hardwired drill pipe, fibre optic cable, or drill collar acoustic telemetry to carry data to the surface.

Advantages of EM telemetry, relative to MP telemetry, include generally faster baud rates, increased reliability due to no moving downhole parts, high resistance to lost circulating material (LCM) use, and suitability for air/underbalanced drilling. An EM system can transmit data without a continuous fluid column; hence it is useful when there is no drilling fluid flowing. This is advantageous when a drill crew is adding a new section of drill pipe as the EM signal can transmit information (e.g. directional information) while the drill crew is adding the new pipe. Disadvantages of EM telemetry include lower depth capability, incompatibility with some formations (for example, high salt formations and formations of high resistivity contrast), and some market resistance due to acceptance of older established methods. Also, as the EM transmission is strongly attenuated over long distances through the earth formations, it requires a relatively large amount of power so that the signals are detected at surface. The electrical power available to generate EM signals may be provided by batteries or another power source that has limited capacity.

A typical arrangement for electromagnetic telemetry uses parts of the drill string as an antenna. The drill string may be divided into two conductive sections by including an insulating joint or connector (a "gap sub") in the drill string. The gap sub is typically placed at the top of a bottom hole assembly such that metallic drill pipe in the drill string above the BHA serves as one antenna element and metallic sections in the BHA serve as another antenna element. Electromagnetic telemetry signals can then be transmitted by applying electrical signals between the two antenna elements. The signals typically comprise very low frequency AC signals applied in a manner that codes information for transmission to the surface. (Higher frequency signals attenuate faster than low frequency signals.) The electromagnetic signals may be detected at the surface, for example by measuring electrical potential differences between the drill string or a metal casing that extends into the ground and one or more ground rods.

There remains a need for downhole systems that can be applied to effectively and reliably communicate data such as MWD data to the surface. There is a particular need for such systems which can provide measurements from sensors located at or near to the drill bit.

SUMMARY

The invention has a number of aspects. Some aspects provide mud motors. Other aspects provide downhole drilling apparatuses.

One aspect of the invention provides a mud motor comprising a housing and a mandrel connected to be driven to rotate by a motor in the housing. In some embodiments, the mandrel comprises a first electrically conductive section comprising a coupling distal to the housing and a second electrically conductive section proximal to the housing wherein the first and second sections of the mandrel are electrically insulated from one another by an electrically insulating gap, and an electromagnetic telemetry transmitter connected across the gap.

In some embodiments, the mud motor further comprises a repeater in the housing wherein the electromagnetic telemetry system is configured to transmit signals to the repeater.

In some embodiments, the electrically insulating gap is removable.

In some embodiments, the mud motor comprises one or more measurement while drilling sensors supported in the mandrel.

In some embodiments, the mud motor comprises an electrical generator driven by the motor and connected to supply electrical power to the measurement while drilling sensors.

In some embodiments, power is conducted from the electrical generator to the measurement while drilling sensors and/or electromagnetic telemetry system in a circuit comprising a first conductor which extends through the mandrel and a current path provided at least in part by the first electrically conductive section of the mandrel.

In some embodiments, the mud motor at least a portion of the electromagnetic telemetry system is enclosed within the mandrel.

In some embodiments, the mud motor comprises an electrical generator driven by the mud motor.

In some embodiments, the mud motor comprises an electrical power accumulator connected between the electrical generator and the electromagnetic telemetry system.

In some embodiments, the mud motor comprises a rotating electrical coupling providing an electrical connection between the mandrel and the housing.

In some embodiments, the rotating electrical coupling comprises one or more electrically-conducting brushes and wherein a first end of the one or more electrically-conducting brushes is in electrical contact with the housing and a second opposite end of the one or more electrically-conducting brushes is in electrical contact with the mandrel.

In some embodiments, the rotating electrical coupling comprises electrically-conductive seals.

In some embodiments, the mud motor comprises an inductive coupling, the inductive coupling comprising a first coil supported by and rotating with the mandrel and a second coil supported by the housing.

In some embodiments, the mud motor comprises a capacitive coupling having a first part on the housing capacitively coupled to a second part on the mandrel.

BRIEF DESCRIPTION OF THE DRAWINGS

The accompanying drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Figure 1:
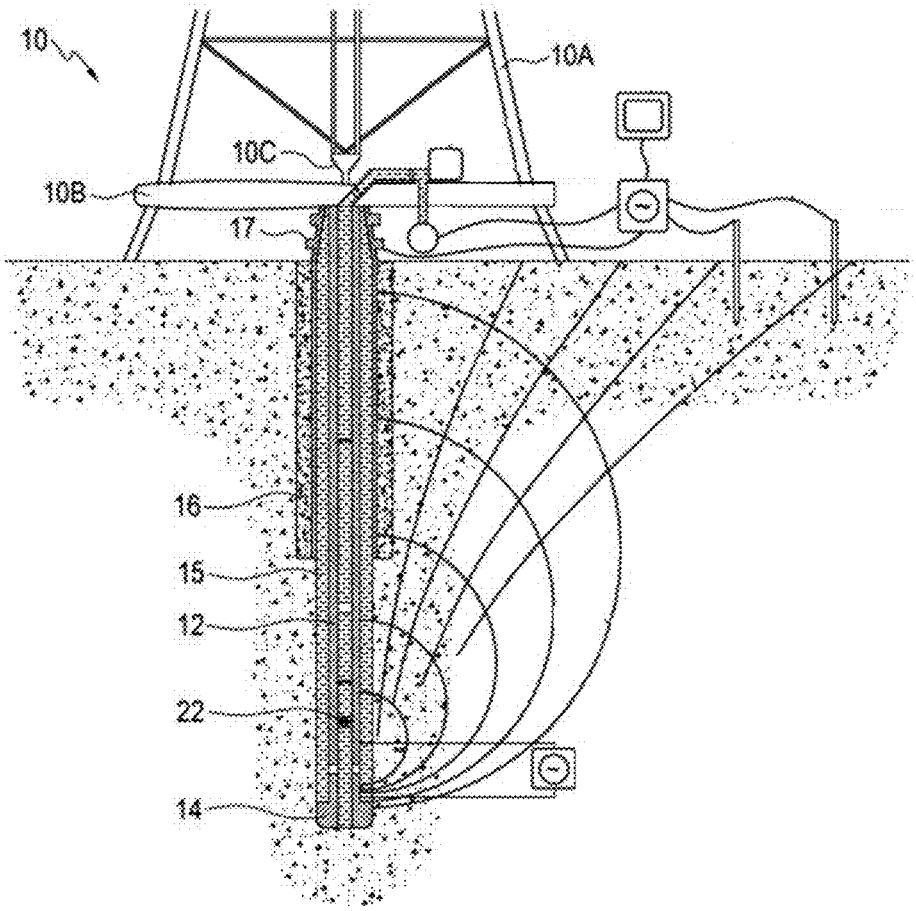
FIG. 1 is a schematic view of a drilling operation.

FIG. 1 shows schematically an example drilling operation. A drill rig 10 drives a drill string 12 which includes sections of drill pipe that extend to a drill bit 14. The illustrated drill rig 10 includes a derrick 10A, a rig floor 10B and draw works 10C for supporting the drill string. Drill bit 14 is larger in diameter than the drill string above the drill bit. An annular region 15 surrounding the drill string is typically filled with drilling fluid. The drilling fluid is pumped through a bore in the drill string to the drill bit and returns to the surface through annular region 15 carrying cuttings from the drilling operation. As the well is drilled, a casing 16 may be made in the well bore. A blow out preventer 17 is supported at a top end of the casing. The drill rig illustrated in FIG. 1 is an example only. The methods and apparatus described herein are not specific to any particular type of drill rig.

One aspect of this invention provides a mud motor which is adapted to provide improved electrical conductivity between uphole and downhole couplings by means of which the mud motor may be coupled into a drill string and/or improved electrical conductivity between the uphole coupling of the mud motor and one or more components of a downhole system located in or connected to a rotatable mandrel of the mud motor.

Figure 2:
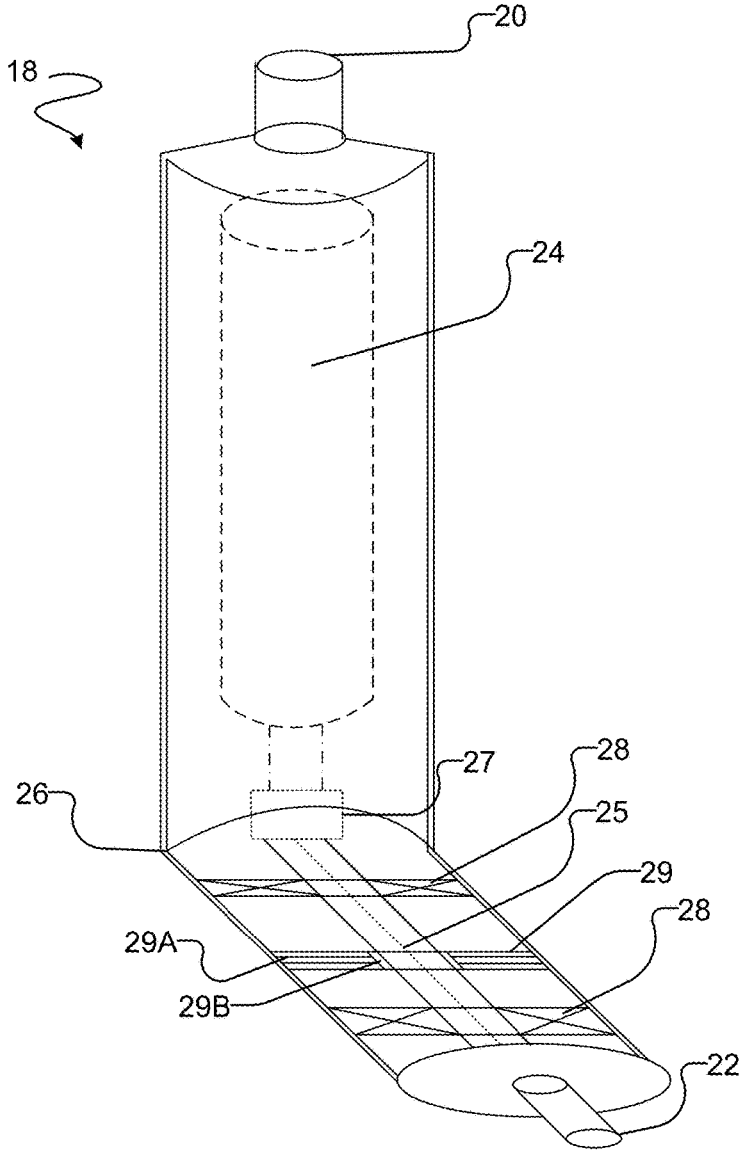
FIG. 2 is a schematic illustration showing a mud motor according to an example embodiment.

FIG. 2 shows a mud motor 18. Mud motor 18 includes a first coupling 20 for coupling to an uphole part of a drill string and a second coupling 22 for coupling to a drill bit. Mud motor 18 includes a power section or motor 24 which drives rotation of a mandrel 25 carrying coupling 22. Mud motor 18 includes a bent section 26 such that the longitudinal axis of downhole coupling 22 is at a slight angle to the longitudinal axis of uphole coupling 20. This bend is used to steer the drill bit for directional drilling. A constant velocity joint 27 carries power from an output shaft of motor 24 to drive mandrel 25.

In EM telemetry, it is desirable that the drill string be electrically conductive since the drill string plays a role in conducting EM signals to the surface and/or in grounding EM telemetry antennas. Typical mud motors do not provide excellent electrical conductivity between their uphole and downhole couplings because mandrel 25 is designed to rotate relative to the rest of the mud motor. In the illustrated embodiment, mandrel 25 is supported for rotation by bearings 28. Bearings 28, constant velocity joints 27, and other components that support and drive mandrel 25 are not typically designed with maintaining high electrical conductivity in mind. The rotation of mandrel 25 can therefore result in fluctuating electrical conductivity through mud motor 18 and/or intermittent grounding of an EM telemetry antenna. This can result in noise being introduced into EM telemetry signals propagating in the vicinity of mud motor 18 and/or a reduction of signal strength at the surface or at a remote drill string location.

Figure 2A:
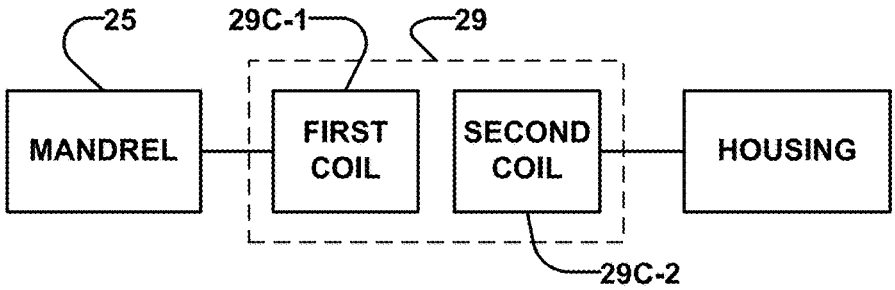
FIGS. 2A, 2B and 2C are schematic views showing example electrical bypass mechanisms.
Figure 2B:
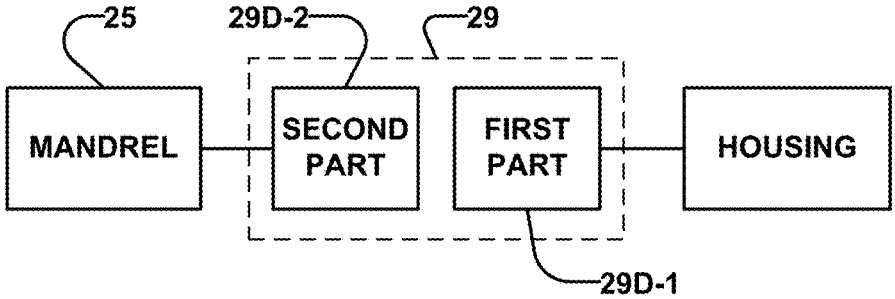

Some embodiments provide a rotary electrical coupling or other electrical bypass mechanism that maintains good electrical conductivity between mandrel 25 and uphole coupling 20. The rotating electrical coupling may, for example, comprise an electrically conducting brush, spring, active inductive coupling, powered inductive coupling, passive inductive coupling, capacitive coupling, relay receiver/transmitter, or the like having one side that is in electrical contact with uphole coupling 20 and another side that is in electrical contact with mandrel 25 which, in turn, may be in electrical contact with downhole coupling 22. This electrical bypass mechanism may be located within the housing of mud motor 18 such that it is protected from being damaged by downhole conditions. The presence of this electrical bypass mechanism can improve the quality (e.g. signal-to-noise ratio) in EM telemetry signals, especially those that are transmitted from locations in the drill string close to the mud motor. In the embodiment of FIG. 2, electrical bypass mechanism 29 comprises brushes 29A in electrical connection with a housing of mud motor 18 that contact a ring 29B in electrical contact with mandrel 25. In some embodiments, as schematically shown in FIG. 2A, electrical bypass mechanism 29 comprises an inductive coupling having a first coil 29C-1 supported by and rotating with mandrel 25 and a second coil 29C-2 supported by the housing of mud motor 18. In some embodiments, as schematically shown in FIG. 2B, electrical bypass mechanism 29 comprises a capacitive coupling having a first part 29D-1 on the housing of mud motor 18 and a second part 29D-2 on mandrel 25.

Figure 2C:
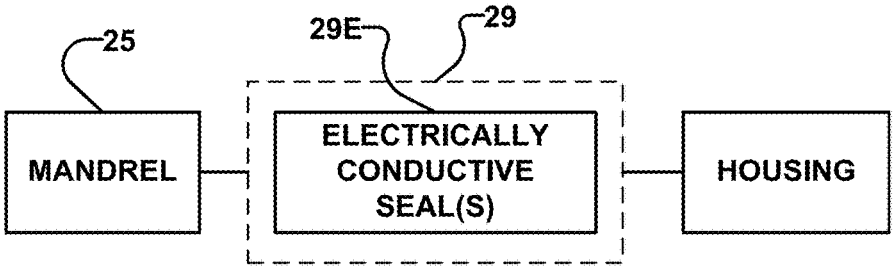

In some embodiments, in addition to or in the alternative to the above, the bypass mechanism 29 comprises electrically-conductive seals 29E, such as O-rings or gaskets, that provide enhanced electrical conductivity between parts separated by a seal 29E (see FIG. 2C). In addition or in the alternative, electrically-conductive elastomers may be applied as a brush/commutator on the mud motor. In addition or in the alternative, in some embodiments the power section of the mud motor comprises electrically-conductive elastomers. For example, the rotor and/or the stator of the mud motor power section may be made of or coated with or comprise an electrically-conductive elastomer.

Electrically-conductive elastomers may be of various types such as electrically-conductive HNBR (Hydrogenated Nitrile Butadiene Rubber), EPDM (ethylene propylene diene monomer (M-class) rubber), silicone, fluorosilicone or the like. These materials may be made electrically conductive by, for example, the incorporation of electrically-conducting particles such as ferrite, carbon, metal particles, and the like. A wide range of electrically-conductive elastomers normally applied for shielding against electromagnetic interference (EMI) are commercially available. For example, electrically conductive seals including O-rings are available from Parker Hannifin Corporation of Cleveland Ohio. Those of skill in the art can select electrically-conductive elastomers suitable for downhole conditions of temperature, pressure and chemical exposure.

Using electrically-conductive elastomers to improve electrical connectivity between components of a mud motor and/or components of the mud motor housing and/or providing the mud motor with a stator and/or rotor that is electrically-conductive can provide additional electrical paths by which current can flow through the mud motor and its housing. This, in turn can reduce or eliminate some sources of electrical noise.

Another aspect of the invention provides a downhole sensory and telemetry system that is integrated with a mud motor. The system may include MWD sensors (e.g. inclination and direction or tool face sensors, shock and vibration sensors, pressure sensors, oil/water cut sensors, any combination of these, or the like). Such sensors may be located close to the drill bit by incorporating them into mandrel 25 of a mud motor like mud motor 18. A telemetry system and supporting control electronics are similarly incorporated into the mud motor, for example, by being enclosed in an electronics package within mandrel 25. Electrical power may be provided by batteries or, in addition or in the alternative, may be provided by a generator connected between rotating mandrel 25 and a stationary part of the mud motor.

Figure 3:
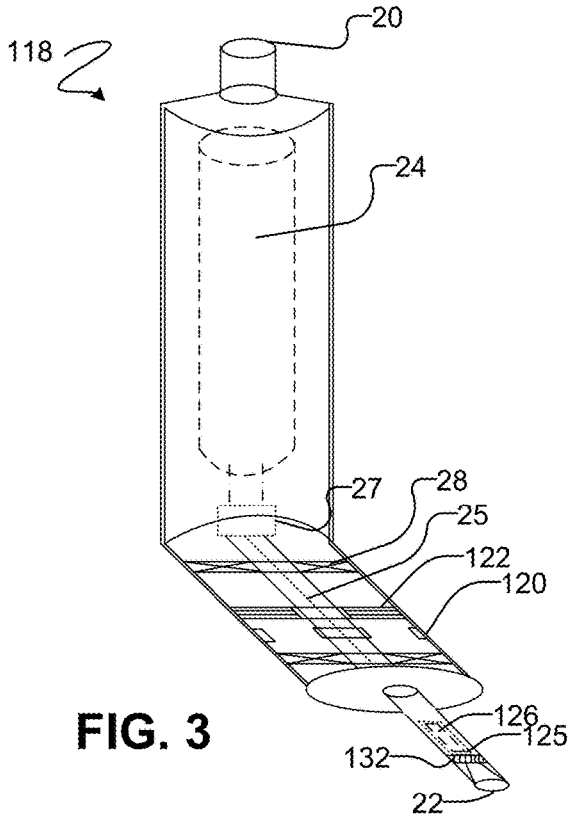
FIG. 3 is a schematic illustration showing a mud motor according to another embodiment.

FIG. 3 is a schematic view showing a mud motor 118. Parts of mud motor 118 that are in common with mud motor 18 are given the same reference numbers. An electrical generator 120 is connected to be driven by the mud motor power section 24. For example, generator 120 may be connected to be driven by rotating mandrel 25. In some embodiments, generator 120 has a rotor directly connected to rotating mandrel 25 and a stator which surrounds the rotor. Mud motor 118 also includes a set of brushes 122 that makes an electrical connection between rotating mandrel 25 and an electrically conductive structure which is in electrical contact with uphole coupling 20. Mandrel 25 has a hollowed out portion 125 which encloses an electronics package 126 comprising one or more sensors.

Electronics package 126 may be supplied with electrical power from generator 120. In some embodiments, power is conducted from generator 120 to electronics in rotating mandrel 25 by a first conductor 121 which extends through rotating mandrel 25 (see FIG. 3B) with a return current path through the material of rotating mandrel 25. In some embodiments, the rotor of generator 120 connects directly to these conductors.

Figure 3A:
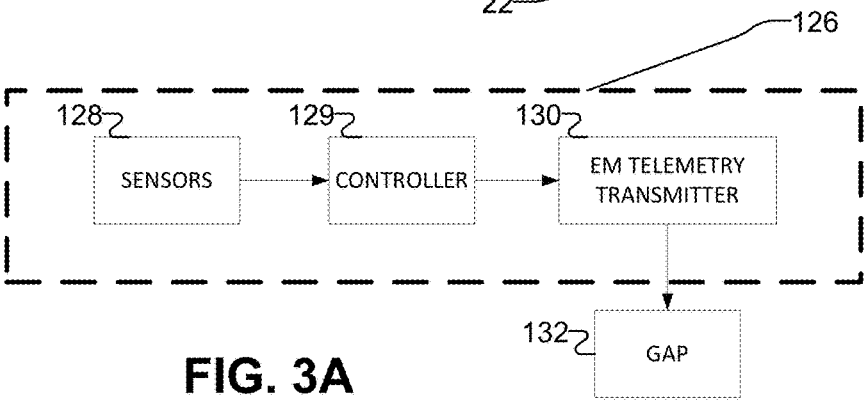
FIG. 3A is a block diagram of an electronics package that may be incorporated into a mud motor.
Figure 3B:
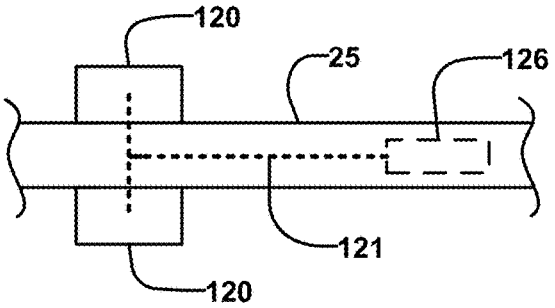
FIG. 3B is a schematic view of an example mandrel having a conductor.
Figure 3C:
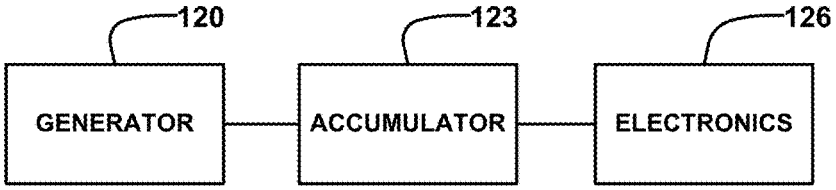
FIG. 3C is a schematic showing an accumulator electrically coupling a generator and an electronics package.

In some embodiments, see e.g. FIG. 3C, an electrical power accumulator 123 such as a capacitor bank and/or a rechargeable battery is electrically connected between generator 120 and the electronics package 126 in rotating mandrel 25 that are to be powered. Power accumulator 123 may be physically located in any suitable location, such as within mandrel 25, within a housing of mud motor 118, or the like.

As shown in FIG. 3A, electronics package 126 comprises a control circuit 129, one or more sensors 128, and a telemetry transmitter 130. In some embodiments telemetry transmitter 130 comprises an electromagnetic (EM) telemetry transmitter.

In operation, data from sensors 128 is acquired by control circuit 129 which causes EM telemetry transmitter 130 to transmit the data which can then be received uphole. The data may be transmitted to surface. In some embodiments the data is carried to the surface by way of a series of data relays. In some embodiments the data is transmitted directly to the surface. In other embodiments, mud motor 118 includes a mud pulser which is controlled to generate mud pressure pulses which encode some or all of the data to be transmitted to the surface. In some embodiments the mud pulser is located above the power section 24 of mud motor 118. In other example embodiments that include a mud pulser the mud pulser is incorporated into mandrel 25. The mud pulser may be controlled by a mud pulse controller, encoder, transmitter, driver, or the like, which may optionally be located in mandrel 25.

Controller 129 may, for example, comprise a programmable processor executing software (which may be firmware) instructions and/or fixed or configurable logic circuits configured to perform the functions described herein.

In embodiments which use EM telemetry to transmit data from the sensors in the rotating mandrel 25, the EM telemetry transmitter may be connected across an electrically-insulating gap 132 which is integrated into rotating mandrel 25. A downhole side of the gap may comprise an electrical conductor which is in electrical contact with the drill bit, and is therefore grounded. An uphole end of the electrically-insulating gap is in electrical contact with uphole coupling 20 and, is thereby in electrical contact with the remainder of the drill string.

In some embodiments, MWD sensors are located near drill bit 14 and are in electrical communication with the EM telemetry transmitter connected across electrically-insulating gap 132. In such an embodiment, the EM telemetry system which is configured to transmit across electrically-insulating gap 132 may transmit data obtained by the MWD sensors to the surface.

Electrically-insulating gap 132, in conjunction with an EM telemetry transmitter, can be used as a standalone EM telemetry system or as a relay in a system having multiple EM telemetry transmitters. For example, at least one additional EM telemetry transmitter/receiver may be provided above the mud motor to improve communication between the EM telemetry transmitter in mandrel 25 and the surface by acting as a relay. In a BHA having insulating gap 132, it may be unnecessary to provide an at-bit EM telemetry transmitter.

Figure 4:
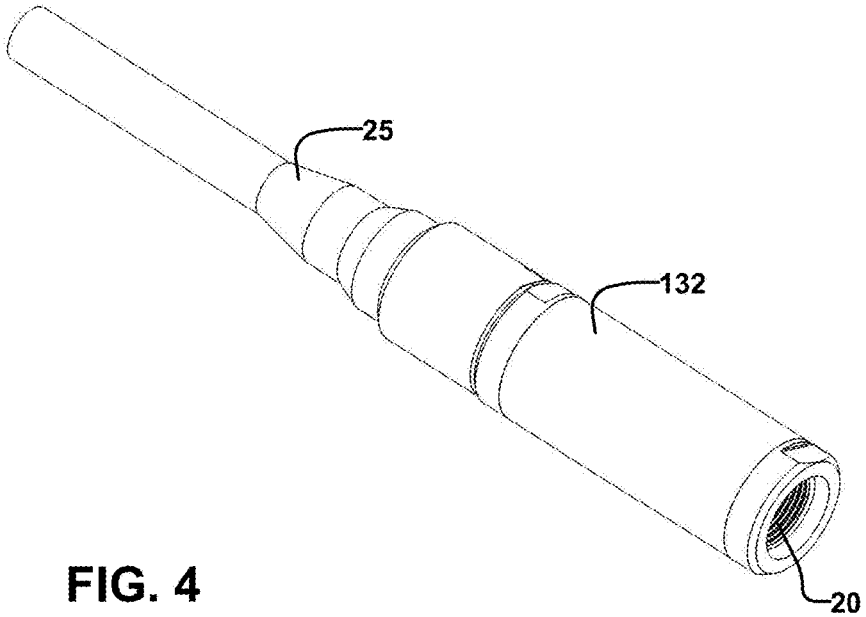
FIG. 4 is a schematic illustration showing a mandrel according to an example embodiment.
Figure 4A:
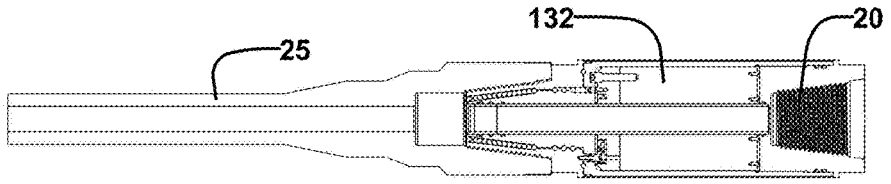
FIG. 4A is a schematic cross-sectional illustration showing a mandrel according to the example embodiment of FIG. 4.

As shown in FIGS. 4 and 4*a*, electrically-insulating gap 132 may be part of a removable component having a male connector end and a female connector end. Accordingly, electrically-insulating gap 132 can be threaded onto mandrel 25 so as to provide an electrically insulated gap across which an EM telemetry transmitter can be connected. In this way, insulating gap 132 can be added to a pre-existing BHA.

Gap 132 can be made of a variety of suitable electrically insulating materials. Electrically insulating materials may, for example, comprise settable material such as a suitable ceramic, plastic, epoxy, cement, engineered resin, thermoplastic, or the like.

Electrically-insulating gap 132 allows for near bit EM telemetry without adding substantial length to the distance between drill bit 14 and bend 26. This increases the ease of steering of drill bit 14. It also facilitates faster and more efficient drilling of straight sections of borehole by continuously rotating the drill string while drill bit 14 turns. Minimizing the distance between drill bit 14 and bend 26 can also beneficially reduce drag of the drill string against the wall of the borehole. Furthermore, maintaining a short bend-to-bit distance allows the use of a drill string in which bend 26 has a reasonably large angle (for example, up to 4°).

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

INTERPRETATION OF TERMS

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof;
- "herein", "above", "below", and words of similar import, when used to describe this specification shall refer to this specification as a whole and not to any particular portions of this specification;
- "or", in reference to a list of two or more items, covers all of the following interpretations of the word: any of the items in the list, all of the items in the list, and any combination of the items in the list;
- the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back"," "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system, etc.) is referred to above, unless otherwise indicated, reference to that component (including a reference to a "means") should be interpreted as including equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A mud motor comprising:

a housing;

a mandrel connected to be driven to rotate by a motor in the housing, the mandrel comprising:

a coupling for coupling to a drill bit;

a first electrically conductive section comprising a coupling distal to the housing, a second electrically conductive section proximal to the housing wherein the first and second sections of the mandrel are electrically insulated from one another by an electrically insulating gap located between the coupling and the motor, and an electromagnetic telemetry system connected across the gap; and a rotating electrical coupling providing an electrical connection between the mandrel and the housing.

2. A mud motor according to claim 1, comprising a repeater in the housing wherein the electromagnetic telemetry system is configured to transmit signals to the repeater.

3. A mud motor according to claim 1, wherein the electrically insulating gap is removable.

4. A mud motor according to claim 1, comprising one or more measurement while drilling sensors supported in the mandrel.

5. A mud motor according to claim 4 comprising an electrical generator driven by the motor and connected to supply electrical power to the measurement while drilling sensors.

6. A mud motor according to claim 5, wherein power is conducted from the electrical generator to the measurement while drilling sensors and/or electromagnetic telemetry system in a circuit comprising a first conductor which extends through the mandrel and a current path provided at least in part by the first electrically conductive section of the mandrel.

7. A mud motor according to claim 1, wherein at least a portion of the electromagnetic telemetry system is enclosed within the mandrel.

8. A mud motor according to claim 1, comprising an electrical generator driven by the mud motor.

9. A mud motor according to claim 8, comprising an electrical power accumulator connected between the electrical generator and the electromagnetic telemetry system.

10. A mud motor according to claim 1, wherein the rotating electrical coupling comprises one or more electrically-conducting brushes and wherein a first end of the one or more electrically-conducting brushes is in electrical contact with the housing and a second opposite end of the one or more electrically-conducting brushes is in electrical contact with the mandrel.

11. A mud motor according claim 1, wherein the rotating electrical coupling comprises electrically-conductive seals.

12. A mud motor according to claim 1 comprising an inductive coupling, the inductive coupling comprising a first coil supported by and rotating with the mandrel and a second coil supported by the housing.

13. A mud motor according to claim 1 comprising a capacitive coupling having a first part on the housing capacitively coupled to a second part on the mandrel.

* * * * *